United States Patent [19]

Boye et al.

[11] 4,381,577

[45] May 3, 1983

[54] VIBRATOR FOR REMOVING PARTICULATE MATERIAL FROM THE CAVITY OF AN ARTICLE

[75] Inventors: David W. Boye, Northford; Neil M. Crockett, Meriden, both of Conn.

[73] Assignee: United Technologies Corporation, Hartford, Conn.

[21] Appl. No.: 303,225

[22] Filed: Sep. 17, 1981

[51] Int. Cl.[3] ..... B08B 5/02

[52] U.S. Cl. ..... 15/304; 15/94; 15/316 R

[58] Field of Search ..... 15/304, 303, 308, 311, 15/316 R, 94; 134/16

[56] References Cited

U.S. PATENT DOCUMENTS

| | | | |
|---|---|---|---|
| 2,038,134 | 4/1936 | Schiffner | 15/94 X |
| 3,573,983 | 4/1971 | Antonevich | 134/184 X |
| 4,325,161 | 4/1982 | Wood et al. | 15/316 R X |

*Primary Examiner*—Chris K. Moore

*Attorney, Agent, or Firm*—Charles A. Warren

[57] ABSTRACT

A mechanism for removing particulate material from the passages through an article or the cavities in an article such as a turbine blade or vane or other mechanical part that involves vibrating the part while simultaneously blowing air through the part with the part so supported as to cause no bending stresses within the part.

4 Claims, 3 Drawing Figures

VIBRATOR FOR REMOVING PARTICULATE MATERIAL FROM THE CAVITY OF AN ARTICLE

DESCRIPTION

1. Technical Field

This invention relates to a device for removing particulate material from a cavity within a machine part or other aritcle and is particularly useful in removing material from the cooling passages in a turbine blade or vane more particularly by a vibratory and air blast technique.

2. Background of Invention

Many turbine blades and vanes particularly in high temperature gas turbines have cooling passages provided either during the casting process or by subsequent mechanical formation as by doing. Before use these passages must be clean and free of any particles that could interfere with the desired coolant flow.

Some of the blades and vanes are coated before use to provide a more effective temperature resistant surface and this coating is frequently accomplished by a pack coating process in which the blade or vane is surrounded and filled with a pack coating powder and is then heated. The powder in the cavities or cooling passages of the blades and vanes must be completely removed before the blade or vane is installed in an engine. Routinely this removal has been a manual process which is both time consuming and is not necessarily entirely effective.

DISCLOSURE OF THE INVENTION

A feature of this invention is an impact and air blast technique by which to set up a vibration to loosen the particles within the blade or vanes with the air blast blowing the particles out of the part. Another feature is the support of the part so that no bending stresses are applied to the part by the impact of the vibratory device so that it might bend or twist the part to an unacceptable configuration or to create undesirable stresses therein.

According to the present invention the blade or vane is mounted in a holder that has an air supply connection for directing air under pressure through the cavity or passages in the part. The assemblage is freely suspended in such a position that a noncritical part of the blade or vane (i.e., a nonfinish machined shroud or root, or a suitably protected finish machined shroud or root) may be positioned between opposing anvils by which the part is successfully vibrated with the vibration loosening any particles within the blade or vane and with the air blast passing through the cavity the particles are readily and quickly blown from within the part.

The foregoing and other objects, features and advantages of the present invention will become more apparent in the light of the following detailed description of the preferred embodiments thereof as shown in the accompanying drawing.

BEST MODE FOR CARRYING OUT THE INVENTION

Figures 1, 2, 3:
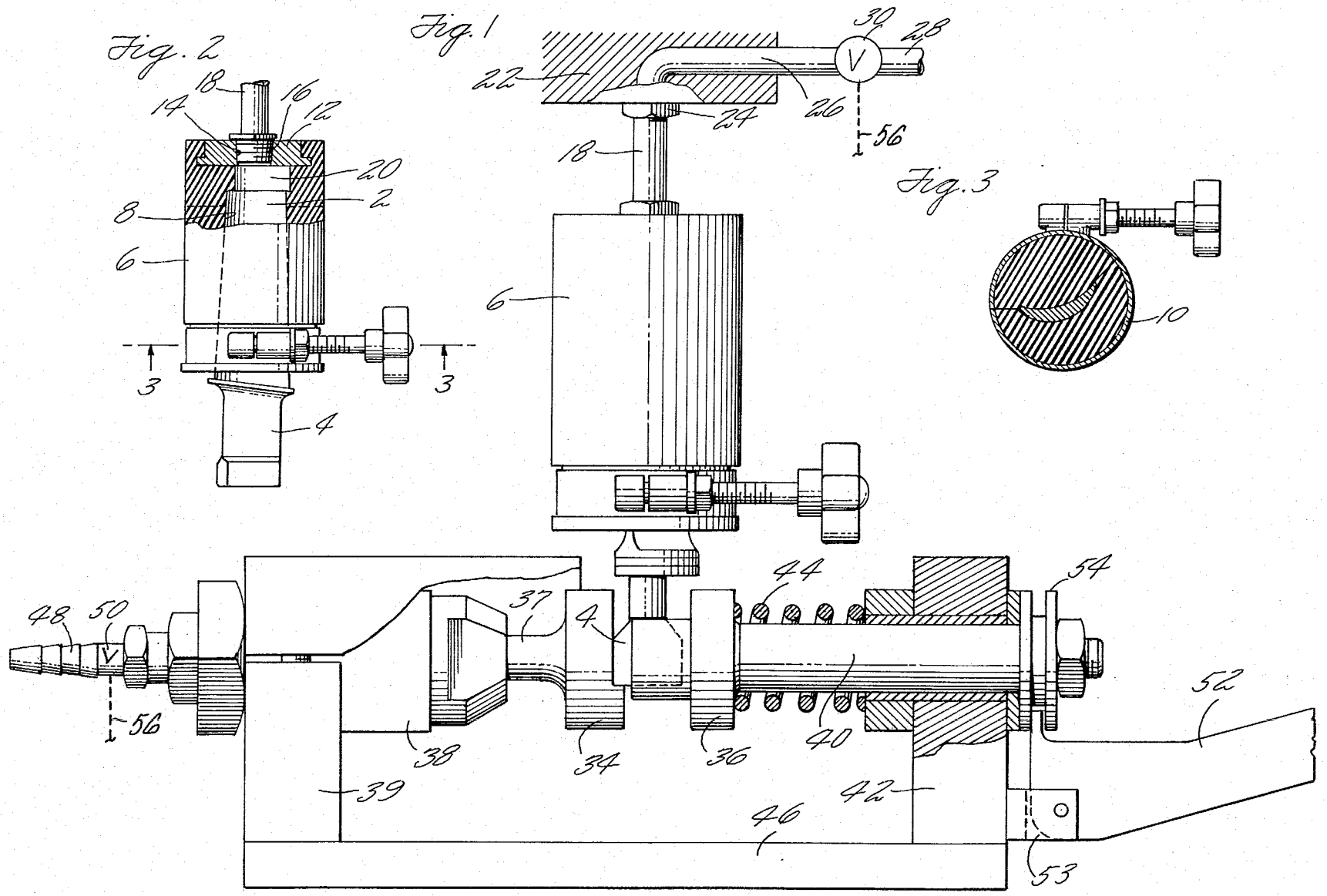
FIG. 1 is a diagrammatic view of a device embodying the invention.
FIG. 2 is an enlargement of the holder for the blade.
FIG. 3 is a sectional view along the line 3—3 of FIG. 2.

The invention is shown as applied to a turbine blade having an airfoil portion 2 and a root portion 4. The airfoil portion is positioned within a holder 6 that is split lengthwise as shown in FIG. 3 for a portion of the length of the blade and has a cavity 8 therein that fits closely around the blade as shown. A ring clamp 10 at the base of the holder clamps the blade securely in position therein. At the upper end of the holder is a ring 12 fitting therein and having a central threaded opening 14 to receive a fitting 16 on the end of an air hose 18. Below the ring 12 in the holder is a passage 20 at the tip of the blade to make sure that air entering the holder will have access to any and all holes at the tip of the blade.

Referring now to FIG. 1 the holder is suspended from a support 22 by the short section of air hose 18 that is threaded at its upper end by a fitting 24 into the support. The latter has a passage 26 therein receiving air from a conduit 28 the latter having a valve 30 therein.

The air hose supports the blade in the holder so that it is somewhat free to swing as a pendulum and so that the root 4 of the blade extending below the holder will be positioned between two anvils 34 and 36 which are in a position to engage opposite sides of the root. The anvil 34 is mounted on the stem 37 of an air hammer 38 of conventional construction on a bracket 39 and the anvil 36 is on a shaft 40 in a bracket 42. A spring 44 holds the anvil in the position shown against the blade root. The air hammer bracket 39 and the bracket 42 are both mounted on a base 46 that also carries the support 22 for the blade and holder. An air supply inlet 48 to the air hammer has a valve 50 therein.

In operation, the blade is prepared for the cleaning operation by making sure that the orifices in the tip and root of the vane or blade are free of sintered material and the external portion being inserted into the holder is clean to produce a proper seal. The blade is then loaded into the holder and secured by tightening the clamp. The holder with the blade therein is positioned so that the blade root is between the two anvils. To permit this the anvil 36 is withdrawn a short distance by a lever 52 connected to a projection 53 on the bracket 42 and engaging a ring 54 on the shaft 40. With the root in position the lever 52 is raised and the root is then in contact with both anvils located on opposite sides of the root.

Both air control valves are then turned on to activate the hammer and admit air under pressure to the tip of the blade. Desirably both valves are interconnected as by a linkage 56 represented diagrammatically. This will cause vibration of the blade or other article and air flow through the article simultaneously. It is desirable to operate the hammer at between 30 and 45 pounds per square inch (100–150 pulses per minute). After a short period the valves are closed, the anvil 36 is retracted by the lever, the holder is moved out so that the blade may be removed from the holder by releasing the clamp. It has been found that this device will clear the cavity or cavities with only a fraction of a minute of operation with the particulate material discharging from the ends of the passages located in the root of the blade. It is understood that these cooling passages or the cavities in the blade extend from the bottom of the root to the tip of the blade as represented by the dotted lines in FIG. 1 since, when the blade is installed in an engine cooling air passes through the blade, this air entering at the root and discharging at the tip.

Although the invention is shown as applied to a blade having a root and no trailing edge cooling holes it is understood that the device is equally applicable to a vane having instead of a root at one end a shroud which would be positioned and supported by the holder such that the end shroud would be engageable by the opposed anvils. In stationary turbine vanes as in the blade constructions the cooling passages extend within the blade or vane from end to end so that a vane could be treated by this device with the same facility as a blade.

Although the invention is described as removing material from the passages or cavity of an article after coating operation, it should be understood that the device is expected to be equally usable in removing the core material from the cavity of a cast blade after the blade or other article is removed from the mold. The same vibratory arrangement will break up and loosen the particles of the core within the article so that they may be blown out by air passing through the blade or vane.

It is expected that the hammer anvil will hit the workpiece with such impact as to bounce the other anvil against the spring away from the workpiece. In this way the spring will then return the spring anvil against the workpiece so that the workpiece receives impacts from both anvils. This doubles the impacts on the workpiece and, being in opposite directions most effectively loosens the material within the passages and the workpiece.

Although the invention has been shown and described with respect to a preferred embodiment thereof, it should be understood by those skilled in the art that other various changes and omissions in the form and detail thereof may be made therein without departing from the spirit and the scope of the invention.

We claim:

1. Apparatus for removing particulate material from internal passages in an article such as a turbine blade or vane, said article having a root at one end and a tip at the other end, said apparatus including supporting means for the article having a recess to receive the tip of the article;

means for releasably clamping the supporting means on said article;

means for supplying air under pressure to said supporting means and thence through the passages in said article;

means for suspending said supporting means and article for relatively free movement;

opposed anvils in spaced relation to one another to engage opposite sides of the root; and means for imparting a vibratory movement to one of said anvils to vibrate the article, said supporting means being laterally offset from and substantially at right angles to the axis of the vibratory movement of the anvil and being flexibly held in position such that the vibratory movement is substantially at right angles to the passages in the article.

2. Apparatus as in claim 1 including spring means acting on the other anvil to hold it against the root.

3. Apparatus as in claim 1 in which the vibratory means is an air hammer.

4. Apparatus as in claim 1 in which there is an air hose supplying air to the supporting means and said air hose suspends the supporting means in position.

* * * * *